United States Patent [19]

Handley et al.

[11] Patent Number: 4,858,409

[45] Date of Patent: Aug. 22, 1989

[54] CEILING PANEL ASSEMBLY

[75] Inventors: John M. Handley, Ridgewood; Ramzi A. Khalifa, Rutherford, both of N.J.; Ramzi A. Khalifa, Bronx, N.Y.

[73] Assignee: Industral Acoustics Company, Inc., Bronx, N.Y.

[21] Appl. No.: 184,862

[22] Filed: Apr. 22, 1988

[51] Int. Cl.[4] ..... E04F 13/00; E04F 19/02

[52] U.S. Cl. ..... 52/489; 52/698

[58] Field of Search ..... 52/277, 278, 222, 60, 52/489, 698; 160/390–395; 24/460, 462, 461

[56] References Cited

U.S. PATENT DOCUMENTS

| | | | |
|---|---|---|---|
| 3,166,117 | 1/1965 | Abadjieff | 160/392 |
| 4,083,157 | 4/1978 | Anthonioz | 52/222 |
| 4,467,504 | 8/1984 | Quist | 160/395 |

*Primary Examiner*—John E. Murtagh

*Attorney, Agent, or Firm*—Morgan & Finnegan

[57] ABSTRACT

The assembly of the present invention includes a support member having a panel support portion for supporting the ceiling panel along its length. The support member also includes a wall fixation portion for affixing the support member to a wall. The assembly also includes a retaining member for retaining one ceiling panel in the assembly, the retaining member having an attachment member engageable with the support member and a clamping portion extending from the attachment member for restraining the ceiling panel in the assembly when the pivot member is fully engaged with the support member. A closure member is disposable between adjacent ceiling panels and is engageable with the support member and the retaining member so as to close the assembly and lock the clamping portion of the retaining member against the ceiling panel.

5 Claims, 2 Drawing Sheets

CEILING PANEL ASSEMBLY

BACKGROUND OF THE INVENTION

The present invention relates to a mounting system or assembly for long span ceiling panels and, in particular, to a ceiling panel assembly that provides a high degree of security against removal or displacement. As such, the invention is particularly adaptable for use in correctional facilities.

Conventional suspended ceiling tiles are generally undesireable for use in applications that require a high degree of security against removal or displacement because they typically allow unauthorized access to above ceiling services and/or permit concealment of weapons, contraband and the like in areas above the ceiling or in gaps or openings between panels. In addition, conventional ceiling panel assemblies generally require that individual panels be cut and fit during installation. Also, conventional systems which use attachment screws or bolts typically require precise alignment and location of adjacent panels. This adds to installation complexity and an increased time for installation which, of course, translates to higher costs.

It is an object of the present invention to provide a ceiling panel assembly that provides a high degree of security against removal or displacement and prevents unauthorized access to areas above the ceiling panels.

It is another object of the present invention to provide a ceiling panel assembly as described above that prevents the concealment of weapons or other potentially dangerous objects in spaces above the ceiling panels.

It is a further object of the present invention to provide a ceiling panel assembly as described above that provides for simplified installation without the need to cut and fit individual panels.

It is another object of the present invention to provide a ceiling panel assembly that allows for alignment of adjacent panels without the use of attachment screws or bolts.

It is a further object of the present invention to provide a ceiling panel assembly, the component parts of which may be manufactured from extruded metal or other processes that provide a uniform cross-section thus enabling the components to engage and lock in a wide range of positions so as to simplify installation.

SUMMARY OF THE INVENTION

The assembly of the present invention includes a support member having a panel support portion for supporting the ceiling panel along its length. The support member also includes a wall fixation portion for affixing the support member to a wall. The assembly also includes a retaining member for retaining the ceiling panel in the assembly, the retaining member having an attachment member engageable with the support member and a clamping portion extending from the attachment member for restraining the ceiling panel in the assembly when the pivot member is fully engaged with the support member. A closure member is disposable between adjacent ceiling panels and is engageable with the support member and the retaining member so as to close the assembly and lock the clamping portion of the retaining member against the ceiling panel.

DETAILED DESCRIPTION OF THE PREFERRED EMBODIMENTS

Figure 1:
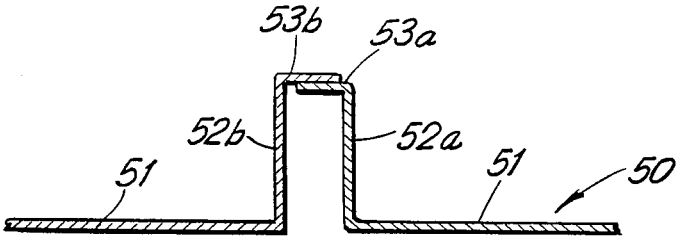
FIG. 1 is a cross-sectional view of ceiling panels that may be used in the assembly of the present invention.
Figure 2:
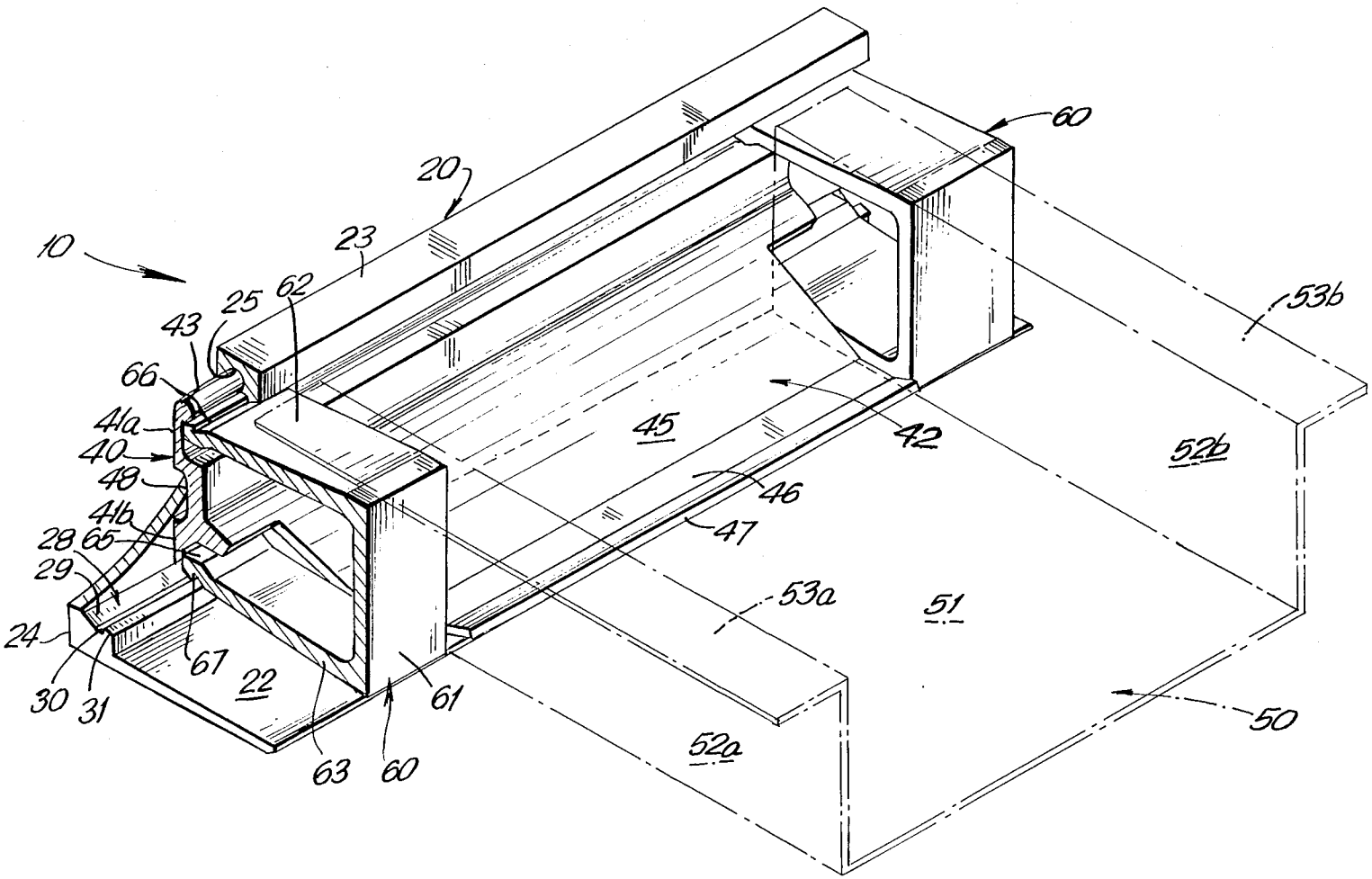
FIG. 2 is a perspective view of the assembly of the present invention which shows a ceiling panel locked in the assembly.

Referring to FIGS. 1 and 2, the ceiling panels 50 that are preferrably used in the assembly 10 of the present invention are generally channel-type panels, having a base portion 51, a pair of opposed side wall portions 52*a* and 52*b* and a pair of shoulder portions 53*a* and 53*b*. It will be understood, however, that other types of ceiling panels may also be used in the subject assembly.

Figure 3:
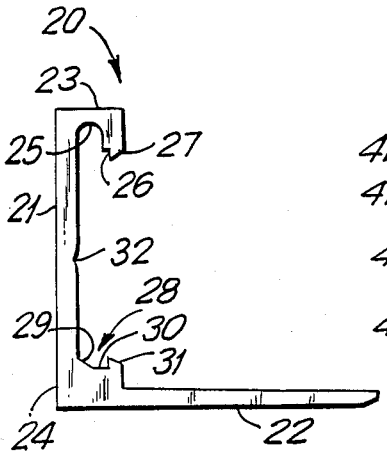
FIG. 3 is a side view of the support member of the subject assembly.

Turning now to FIGS. 2 and 3, the subject assembly 10 includes a support member 20 which is adapted for attachment to the side walls of a corridor or occupied space for providing continuous support for the base surface 51 of ceiling panels 50. Support member 20 includes a wall fixation member 21 which may be fastened to the wall by any suitable means such as screw or bolt means at point 32. Preferably wall fixation member 21 is flat so as to lie flush against the wall. Wall fixation member 21 includes two end portions 23 and 24. End portion 23 preferably includes a rounded groove 25, an undercut slot portion 26 and a lip portion 27. End portion 24 includes a groove 28, preferably including an engagement surface 29, a locking surface 30 and a lip portion 31. Support member 20 further includes a panel supporting surface 22 for supporting surface 51 of ceiling panel 50.

In the preferred embodiment of the invention, support member 20 is unitary in construction and may be manufactured from extruded metal or other processes that provide a uniform cross-section.

Figure 4:
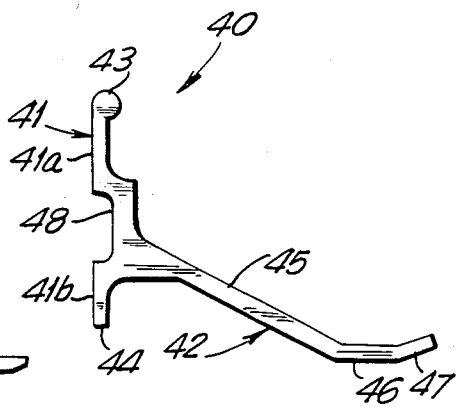
FIG. 4 is a side view of the retaining member of the subject assembly.
Figure 6:
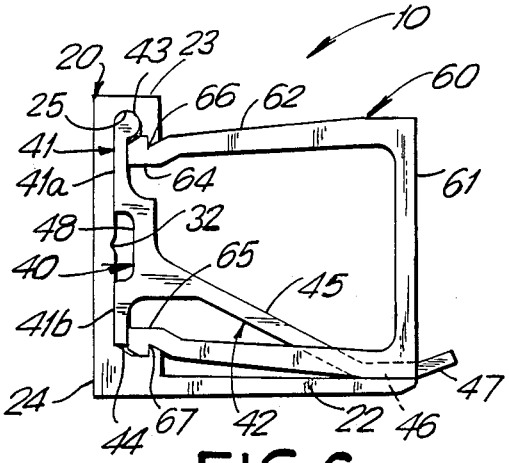
FIG. 6 is a side view showing the support member, retaining member and closure member of the subject assembly in the fully locked state.

Referring to FIGS. 2, 4 and 6 the subject assembly 10 also comprises a retaining member 40 for retaining the ceiling panel 50 in the assembly. Retaining member 40 includes an attachment member 41 which is engageable with support member 20. In the preferred embodiment of the invention, attachment member 41 preferably includes a pair of planar surfaces 41*a* and 41*b* and a central recessed portion 48. In addition, attachment member 41 preferably includes a rounded end portion 43 and a second end portion 44.

Retaining member 40 further includes a clamping member 42, which as shown in the Figures, extends diagonally downwardly from attachment member 41. Clamping member 42 preferrably includes an extension portion 45 a locking portion 46 and a lift portion 47. Retaining member 40 is also preferably unitary in construction and made from extruded metal or other processes that provide a uniform cross-section.

Figure 5:
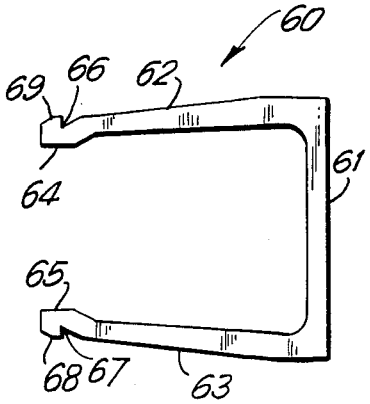
FIG. 5 is a side view of the closure member of the subject assembly.

Referring to FIGS. 2, 5 and 6, the subject assembly 10 further comprises a closure member 60 which is disposable between adjacent ceiling panels 50 and engageable with support member 20 and retaining member 40 so as to close the assembly and lock clamping portion 46 of retaining member 40 against the ceiling panel.

In the preferred embodiment of the invention, closure member 60 is generally U-shaped in configuration having a central wall portion 61 and first and second leg members 62 and 63. Leg portion 62 includes a free end portion 64 having a lip 69 and locking groove 66. Similarly, in the preferred embodiment of the invention, leg portion 63 includes a free end 65 having a lip portion 68 and a locking groove 67. As with support member 20 and retaining member 40, it is preferrable that closure member 60 be manufactured from extruded metal or other processes that provide a uniform cross-section.

Referring to FIGS. 2 and 6, the assembly of the subject invention in the fully locked state will now be discussed. As illustrated, wall fixation member 21 of support member 20 may be suitably fastened to a wall, for example, by screw or bolt means through an aperture 32. Preferably, wall fixation member 21 lies flush against the wall and is tightly fastened thereto. A ceiling panel 50 is located on and supported by support surface 22 of support member 20. Preferably, support surface 22 is at a 90 degree angle to wall fixation member 21. Rounded end portion 43 is receivable in rounded groove 25 of support member 20. The cooperation between rounded end portion 43 and rounded groove 25 make retaining member 40 pivotally movable with respect to support member 20 while the assembly is in the unlocked state.

In the preferred embodiment of the invention, surfaces 41*a* and 41*b* lie flush against the inside surface of wall fixation member 21 so that retaining member 40 will lie tightly in place when the assembly is in the locked state.

As shown best in FIG. 6, when surfaces 41*a* and 41*b* of retaining member 40 lie flush against wall fixation member 21, end portion 44 of retaining member 40 is located in groove 28 against surface 29. To install a panel 50, lift portion 47 of retaining member 40 may be lifted such that retaining member 40 pivots around rounded edge portion 43. Once the ceiling panel is located onto support surface 22 of support member 20, retaining member 40 may be pivoted downwardly such that locking portion 46 presses against surface 51 of the ceiling panel. To lock the assembly, closure member 60 is installed such that lip portion 27 of support member 20 fits into groove 66 of closure member leg 62 while lip portion 69 of closure member leg 62 is received into slot portion 26 of support member 20. Similarly, lip portion 68 of closure member leg 63 is received into slot 30 of support member 20 and lip member 31 of support member 20 is received into slot 67 of closure member leg 63.

With assembly 10 in the fully locked state, closure member 60 cooperates with support member 20 and retaining member 40 so as to tightly lock retaining member 40 into place such that it is not moveable and such that locking surface 46 presses tightly against ceiling panel surface 51. As a result, neither retaining member 40 nor the ceiling panel 50 may be displaced.

In accordance with the invention, closure members 60 are preferably contoured to fit exactly in the space between adjacent ceiling panels. In contrast, a conventional restraint system using fasteners located at discreet intervals typically requires some clearance between the components to allow for manufacturing tolerances. The assembly of the subject invention enables engagement at any point along support member 20 and permits the panels to be assembled with no clearance between adjacent components.

From the above description, it will be readily apparent to those skilled in the art that other modifications may be made to the present invention without departing from the scope and spirit thereof as pointed out in the appended claims.

What is claimed is:

1. An assembly for affixing a rigid ceiling panel to a wall member comprising:

a support member having a substantially flat panel support portion for supporting the ceiling panel such that the panel may lie flush against the panel support portion and extend away from the wall member and a wall fixation member for affixing the support member to the wall member;

a retaining member for retaining the ceiling panel in the assembly, the retaining member including an attachment member engageable with the support member and a clamping portion extending from the attachment member for restraining the ceiling panel in the assembly and against the panel support portion when the attachment member is fully engaged with the support member; and a closure member disposable on the panel support portion and against to the ceiling panel, the closure member being engageable with said support member and said retaining member so as to close the assembly and lock the clamping portion of the retaining member against the ceiling panel.

2. An assembly as recited in claim 1 wherein said wall fixation member includes first and second end portions, said first end portion including a groove and a slot, said second end portion including a slot and associated lip.

3. An assembly as recited in claim 2 wherein said attachment member includes first and second end portions, one end portion being pivotably receivable in the groove of said wall fixation member the second end portion of said attachment member being receivable in the slot of the second wall fixation member end portion.

4. An assembly as recited in claim 3 wherein said closure member is generally U-shape having a central wall portion and first and second leg portions, each leg portion having a free end, said first leg portions being engageable with the panel support surface of said support member, the free end of said first leg portion being receivable in the slot of said second wall fixation member end portion, the free end of said second leg portion being engageable with said wall fixation member and receivable in the slot of said first end portion of said wall fixation member.

5. An assembly for affixing a ceiling panel to a wall member comprising:

a support member having a panel support portion for supporting the ceiling panel and a wall fixation member for affixing the support member to the wall member, said wall fixation member including first and second end portions, said first end portion including a groove and a slot, said second end portion including a slot and associated lip;

a retaining member for retaining the ceiling panel in the assembly, the retaining member including an attachment member engageable with the support member and a clamping portion extending from the attachment member for restraining the ceiling panel in the assembly and against the panel support surface when the attachment member is in fixed engagement with the support member, said attachment member including first and second end portions, one end portion being pivotably receivable in the groove of said wall fixation member the second end portion of said attachment member being receivable in the slot of the second wall fixation member end portion; and a closure member disposable between ceiling panels and engageable with said support member and said retaining member so as to fixedly engage the retaining member with the support member and lock the clamping portion of the retaining member against the ceiling panel, said closure member being generally U-shape having a central wall portion and first and second leg portions, each leg portion having a free end, said first leg portions being engageable with the panel support surface of said support member, the free end of said first leg portion being receivable in the slot of said second wall fixation member end portion, the free end of said second leg portion being engageable with said wall fixation member and receivable in the slot of said first end portion of said wall fixation member.

* * * * *

UNITED STATES PATENT AND TRADEMARK OFFICE

CERTIFICATE OF CORRECTION

PATENT NO. : 4,858,409

DATED : August 22, 1989

INVENTOR(S) : John M. Handley, Ramzi A. Khalifa, Frank Zuvich

It is certified that error appears in the above-identified patent and that said Letters Patent is hereby corrected as shown below: On the title page:

Inventors: Change "John M. Handley, Ridgewood; Ramzi A. Khalifa, Rutherford, both of N.J.; Ramzi A. Khalifa, Bronx, N.Y." to -- John M. Handley, Ridgewood; Ramzi A. Khalifa, Rutherford, both of N.J.; Frank Zuvich, Blauvelt, N.Y. --.

Signed and Sealed this

Twelfth Day of March, 1991

*Attest:*

HARRY F. MANBECK, JR.

*Attesting Officer*

*Commissioner of Patents and Trademarks*